United States Patent [19]

Soleanski

[11] Patent Number: 4,749,358

[45] Date of Patent: Jun. 7, 1988

[54] DEVICE FOR THE SUSPENSION AND LIGHTING OF OBJECTS

[76] Inventor: Christian B. Soleanski, 38 Bis rue Fontaine, 75009 Paris, France

[21] Appl. No.: 22,886

[22] Filed: Mar. 6, 1987

[30] Foreign Application Priority Data

Mar. 6, 1986 [FR] France ..... 86 03175

[51] Int. Cl.[4] ..... H01R 25/14

[52] U.S. Cl. ..... 439/119; 439/121

[58] Field of Search ..... 439/110–122, 439/207–216, 489, 490, 488

[56] References Cited

U.S. PATENT DOCUMENTS 1,226,813 5/1917 Rowntree ..... 439/209
3,391,377 7/1968 Corl et al. ..... 439/116
3,686,613 8/1972 Barski ..... 439/116

FOREIGN PATENT DOCUMENTS 1135576 3/1963 Fed. Rep. of Germany .
2410016 9/1975 Fed. Rep. of Germany .
2402947 4/1979 France .
1395649 5/1975 United Kingdom ..... 439/212

*Primary Examiner*—Gil Weidenfeld
*Assistant Examiner*—Gary F. Paumen
*Attorney, Agent, or Firm*—Lowe, Price, LeBlanc, Becker & Shur

[57] ABSTRACT

Bar carrying electrical conductor is joined at one end to a coupling module adapted to be engaged on a rail and carrying electrical contact pieces designed to contact with conductors running along the rail, thereby ensuring: (a) the mechanical junction between the rail and the bar, and (b) the electrical connection between the conductors of the rail and the conductors of the bar. A connecting module and a hook are mounted on the bar, and both are adjustable along the bar. The connecting module has contact elements engaging conductors in the bar and a socket so that when an object to be lighted is suspended from the hook its plug can be inserted into the socket for an electrical connection through conductors in the bar to a source of electrical energy in the rail.

5 Claims, 3 Drawing Sheets

DEVICE FOR THE SUSPENSION AND LIGHTING OF OBJECTS

BACKGROUND OF THE INVENTION

The present invention relates to a suspended device for lighting objects such as, for example, paintings, tapestries, sculptures, . . . , and more particularly a device of the type comprising hanging means adapted to be hung on a horizontal rail, said means being equipped with electrical contact pieces designed to be guided into contact with electrical conductors running along the rail, thus ensuring the mechanical link between the rail and an object fixed on the fastening member and the electric connection between the rail and the lighting means associated to the object.

DESCRIPTION OF THE PRIOR ART

German Patent Application No. 2 410 016 describes a device of this type comprising two hooks which are fixed to the object and which fasten on to a rail, each hook coming into contact with one special bar-shaped conductor, carried by the rail.

A large number of other systems are known for suspending a light fixture in any selected part of a rail. For example, U.S. Pat. No. 3,391,377 describes more particularly a connecting piece connected via a flexible conductor to the lamp of the lighting fixture and provided with pointed contact pieces capable of perforating an insulation protecting the conductors carried by the rail. The lighting fixture is hung separately by way of rods fastening onto the rail.

One advantage of the aforementioned known devices resides in the possibility of changing at discretion the location of the object suspended on the rail.

However, and in particular in the case of devices for suspending and lighting works of art, such as for example in an exhibition, it is also an advantage to provide means which combine the functions of suspension and of electrical supply in the simplest way possible while being re-usable for different type of objects and while permitting the adjustment of the position of the objects, not only horizontally along the rail but also vertically.

OBJECT AND SUMMARY OF THE INVENTION

It is the object of the present invention to propose a device which fulfills the aforesaid requirements.

This object is reached with a device of the type defined hereinabove and which comprises:

a bar with electrical conductors carried by the bar therealong, means for hooking an object, which means are mounted on the bar, and the position of which is adjustable along said bar, a coupling module fixed on one end of the bar so as to be engageable on the rail for suspending the bar and the object hanging thereon, the coupling module comprising contact pieces which are respectively connected to the conductors carried by the bar and which project from the coupling module so as to contact respectively with conductors carried by the rail when said coupling module is engaged on said rail, and a connecting module mounted on the bar, the position of which is vertically adjustable along said bar, said connecting module comprising connecting elements adapted to be electrically connected to a lighting device and which can be respectively brought in contact with conductors carried by the bar.

Thus, the bar is used as a suspension member on the rail and as a member ensuring the electrical connection with the conductors of the rail, and the positions of the means for hooking an object and of the connecting module which a lighting device can plug into, are adjustable vertically along the bar.

BRIEF DESCRIPTION OF THE DRAWINGS

The invention will be more readily understood on reading the following description with reference to the accompanying drawings in which.

DESCRIPTION OF A PREFERRED EMBODIMENT

Figure 1:
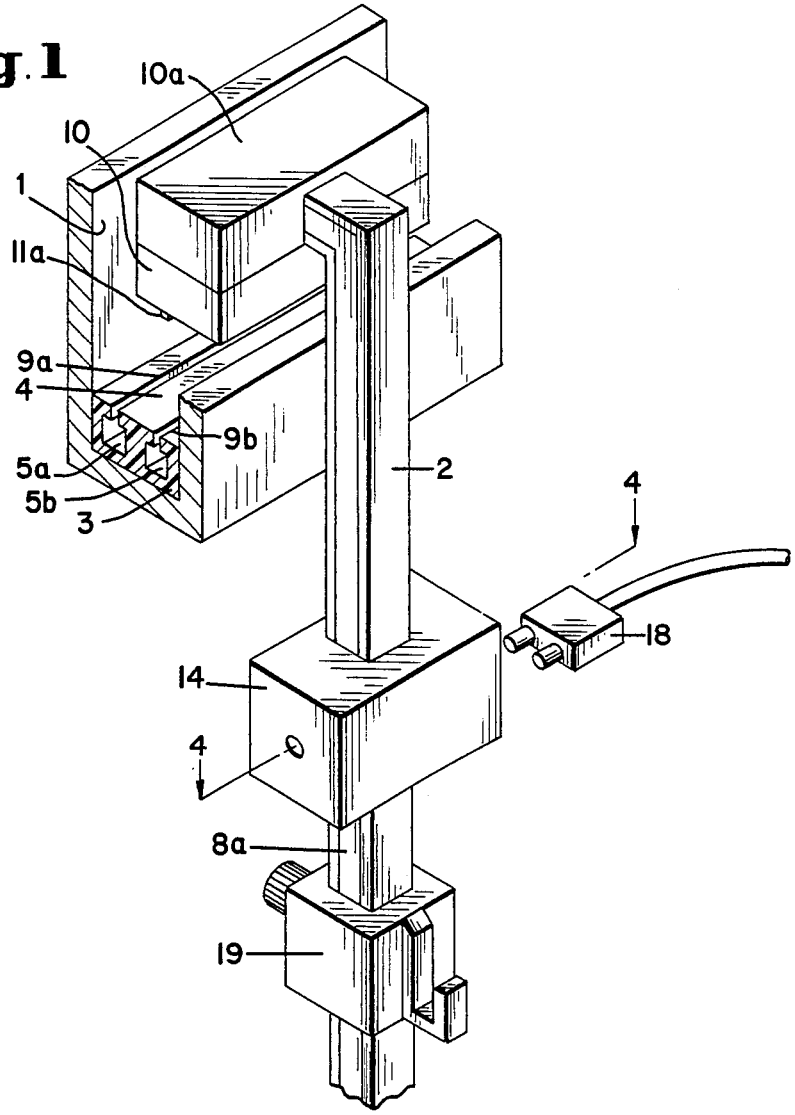
FIG. 1 is a general view showing the different elements of one embodiment of the device according to the invention, in a non-assembled configuration.

Referring first to FIG. 1, the suspension and lighting device comprises a rail 1 in metal or plastic material designed to be fixed horizontally on a wall or on any other vertical or horizontal part. The rail 1 forms a supporting element for one or more bars 2 of rectangular or square cross-section, said bar or bars being also in metal or plastic material.

Figure 2:
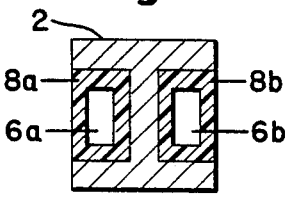
FIG. 2 is a cross-sectional view of the device shown in FIG. 1.
Figure 3:
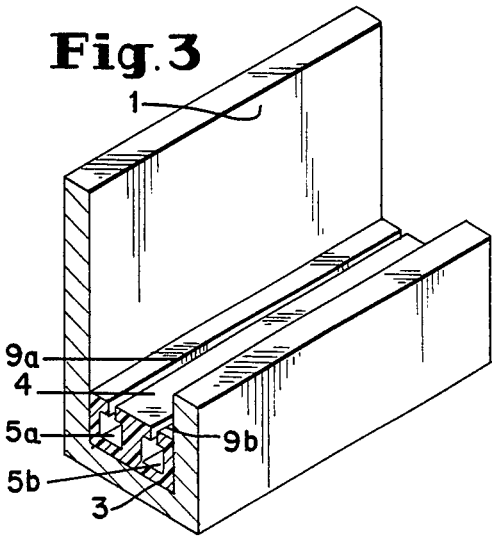
FIG. 3 is a partial view of the rail of the device of FIG. 1.

Rail 1 (FIGS. 1,3) forms not only a supporting structure, but also an electric supply rail. Two electrical conductors 5*a*, 5*b* are embedded in an insulating casing 4 extending longitudinally over the whole length of the rail at the bottom of a channel 3 formed by the rail. Conductors 5*a*, 5*b* are accessible through grooves 9*a*, 9*b* formed in the insulating casing 4, from the upper face thereof and through the full length of the rail. Bar 2 (FIGS. 1, 2) is also equipped throughout its length with electrical conductors 6*a*, 6*b* embedded in insulating casings 8*a*, 8*b* which are contained in grooves formed along said bar on the two opposite faces thereof.

At one end, bar 2 is electrically and mechanically connected with rail 1 by way of a coupling module 10, whereas a connecting module 14 and a hooking piece 19 are mounted on bar 2 thus allowing respectively the electric supply to a light bulb and the hanging of an object (not shown).

Figure 4:
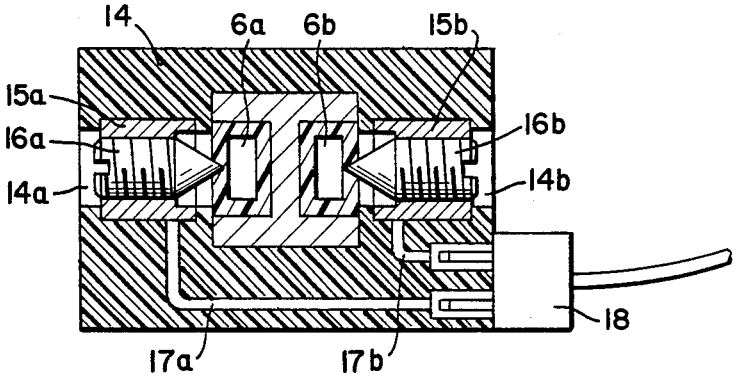
FIG. 4 is a cross-section along plane B—B of FIG. 1 of the connecting module mounted on the bar of the device.

As illustrated in FIG. 4, the connecting module 14, preferably in plastic material, is provided with a vertical passage with a cross-sectional configuration corresponding to that of bar 2 so that said module can be engaged on said bar. Horizontal passages 14*a*, 14*b* are formed in the block 14, which passages open at one of their ends, on two opposite sides of said block 14, and at their other ends, into the passage traversed through by the bar 2, at the level of the insulating casings 8*a*, 8*b*. Metallic rings 15*a*, 15*b* are inserted in the two passages 14*a*, 14*b*, and locked longitudinally therein, for example by molding a piece over said block 14. Needle screws 16*a*, 16*b* are screwed in the rings 15*a*, 15*b*. Conductors 17*a*, 17*b* are embedded in the block 14 and connect the rings 15*a*, 15*b* with a socket formed on one side of the block 14 to allow the plugging in of a plug 18 supplying a light (not shown).

Thus, the position of the connection block 14 along the bar, is readily adjustable, the electrical connection with the conductors *6a, 6b* of said bar being achieved by perforating the insulating casings *8a, 8b* with the pointed ends of the needle-screws *16a, 16b* when these are screwed into rings *15a, 15b*.

Although needle-screws are used in the illustrated embodiment, it is also possible to use any other conventional device permitting an electrical connection, such as for example a device of the self-stripping type.

The hooking piece 19 is also produced so as to be slidable along the bar 2. In the illustrated example, said piece 19 is in the form of a block provided with a hook, the securing of which on the bar being achieved by locking with a screw, or by self-locking under the weight of the suspended object (not shown). Obviously any other form of hooking piece can also be used.

Figure 5:
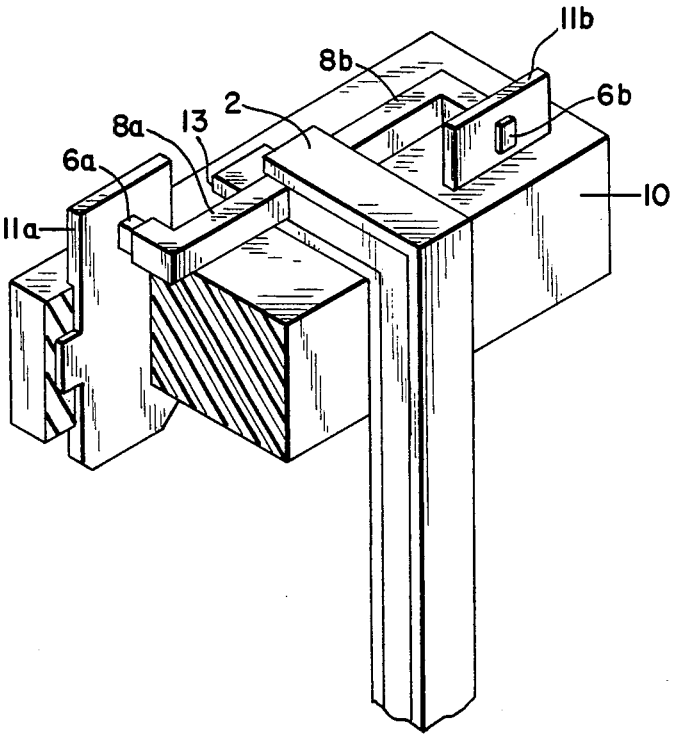
FIG. 5 is a partial perspective of the coupling module between the bar and the rail.

The coupling module 10 is a piece of general parallelepipedal shape, of plastic material for example. The shape of said module 10 is so selected as to enable said module to fit in the channel 3 of the rail 1, above the casing 4, while being guided between vertical sides of the rail defining laterally the channel 3. A recess 13 is formed in module 10 to receive the end portion bent at 90° of the bar 2 (FIGS. 1 and 5). In the illustrated example, the coupling module 10 is in two parts, one lower part engaging into the channel provided in rail 1, and one upper part 10*a* forming a cover and clamping over the bent portion of bar 2.

As more particularly illustrated in FIG. 5, contact pieces *11a, 11b* are vertically inserted in the coupling module 10 and are locked in position therein for example by molding the lower part of said module over said contact pieces *11a, 11b*. Conductors *8a, 8b* of the bar 2 extend beyond the bent end portion of the bar 2 in order to be connected with contact pieces *11a, 11b* by soldering or any other suitable means. The cover 10*a* and the lower part of the coupling module 10 are so shaped as to clamp around the bent end portion of bar 2, the extensions of the conductors *8a* and *8b* and the parts of the contact pieces *11a, 11b* to which said conductors are connected. The junction between the cover 10*a* and the lower part of the module 10 is achieved by any suitable means, such as for example screws (not shown) or adhesive bonding.

On the lower side of the coupling module 10, contact pieces *11a, 11b* project in such positions and over such a length as to be able to penetrate into the grooves *9a, 9b* over a sufficient distance to enable them to contact with conductors *5a, 5b* of the rail. Electrical connection between contact pieces *11a, 11b* and the respective conductors *5a, 5b* is efficiently achieved under the effect of the weight of the suspended object, said weight being transmitted to the module 10 by the bar 2, owing to its bent end portion which engages into the module 10, said latter being vertically guided between the vertical sides of the channel 3 in rail 1.

The bar 2 and the coupling module 10 can easily be moved along the rail 1 just by disengaging and re-engaging the bar, and re-engagement permitting simultaneously the mechanical connection and electrical connection.

Unhooking of the object suspended on the bar interrupts the electric supply to the lighting device insofar as the weight of the bar alone is not sufficient to keep the connection with the conductors of the rail. Such interruption may be turned to profit to produce an alarm signal by detection of the electrical resistance variation in the load circuit supplied by conductors *5a, 6b*, upon disconnection of the lighting device. The electrical resistance variation is detected by any suitable means such as for example a circuit with a Wheatstone bridge, Preferably, since the electrical supply is achieved by a circuit with two ungrounded conductors, a source of low voltage or very low voltage will be used.

What is claimed is:

1. Device for the suspension and lighting of objects comprising hanging means adapted to be hung on a horizontal rail and carrying electrical contact pieces designed to be brought into contact with electrical conductors running along the rail, whereby electrical connection between the conductors on the rail and lighting means operationally coupled to an object hooked on the hanging means can be ensured, said hanging means comprising:

a bar with electrical conductors carried by said bar along the length thereof;

hooking means for mounting said object on the bar, the position of said hooking means being adjustable along said bar, a coupling module mounted on one end of the bar and adapted to be engageable on the rail for suspending the bar and the object hanging thereon, said coupling module comprising contact pieces which are respectively connected to the conductors carried by the bar and which project from the coupling module so as to contact respectively with said conductors carried by the rail when said coupling module is engaged on said rail, and a connecting module mounted on the bar, the position of which is vertically adjustable along said bar, said connecting module comprising connecting elements adapted to be electrically connected to said lightening means and brought into contact with said conductors carried by the bar.

2. Device as claimed in claim 1, wherein means are provided for signalling the unhooking of the object suspended on the bar by detecting the deconnection of the lighting device resulting from an interruption in the electrical connection with the electrical conductors of the rail.

3. The device of claim 1, wherein the conductors on the rail are enclosed in insulating material having grooves therein and the contact pieces on said coupling module project into the grooves to make electrical contact with the conductors.

4. The device of claim 1, wherein the rail defines a channel having the electrical conductors there within and said coupling module is adapted to be seated in the channel.

5. The device of claim 1, wherein the conductors in said bar are covered with insulating material and the connecting elements in said connecting module perforate the insulating material to make electrical contact with the conductor.

* * * * *